United States Patent [19]

Van Es

[11] Patent Number: 4,826,139

[45] Date of Patent: May 2, 1989

[54] STOPPER FOR A TAP HOLE OF A STEEL CONVERTER AND METHOD OF OPERATING A CONVERTER

[75] Inventor: Machiel A. H. Van Es, Beverwijk, Netherlands

[73] Assignee: Hoogovens Groep B.V., Ijmuiden, Netherlands

[21] Appl. No.: 93,627

[22] Filed: Sep. 8, 1987

[30] Foreign Application Priority Data

Sep. 8, 1986 [NL] Netherlands ..... 8602255

[51] Int. Cl.[4] ..... C21C 5/28

[52] U.S. Cl. ..... 266/272; 222/597

[58] Field of Search ..... 266/45, 272, 271; 222/597, 591

[56] References Cited

U.S. PATENT DOCUMENTS 4,010,936 3/1977 Takashima ..... 266/45
4,399,986 8/1983 Collins ..... 266/45
4,471,950 9/1984 LaBate ..... 266/272

FOREIGN PATENT DOCUMENTS 1145205 3/1963 Fed. Rep. of Germany .
0071494 11/1978 Luxembourg .
7612060 10/1976 Netherlands .
1515629 6/1978 United Kingdom .

*Primary Examiner*—Scott Kastler
*Attorney, Agent, or Firm*—Stevens, Davis, Miller & Mosher

[57] ABSTRACT

A stopper for a tap hole of a steel converter has a plug which can at least partly be fitted into the tap hole, and holding means for holding the plug in place in the tap hole. To avoid entry of slag into the tap hole, even on initial tipping, the plug is substantially cylindrical in shape and can be moved along the whole length of the tap hole. The holding means are adapted to lose their holding action when the stopper is subjected to the heat of the molten steel upon tipping of the converter.

5 Claims, 1 Drawing Sheet

STOPPER FOR A TAP HOLE OF A STEEL CONVERTER AND METHOD OF OPERATING A CONVERTER

BACKGROUND OF THE INVENTION

1. FIELD OF THE INVENTION

The invention relates to a stopper for a tap hole of a steel converter, comprising a plug which is dimensioned so that it fits at least partly into the tap hole. The invention also relates to a method of operating a steel converter having a tap hole, in which such a stopper is removed from the tap hole by the action of the molten steel on tipping of the converter.

2. DESCRIPTION OF THE PRIOR ART

In order to tap the steel refined in the converter the converter is tipped. Unless the tap hole is blocked, tapping will start with the casting of a quantity of slag, the so-called initial slag, which floats on the steel. The quantity of this slag which is tapped depends on the speed at which the converter is tipped and the size of the tap hole.

The steel following the slag through the tap hole is still unkilled which means that it contains a lot of unbound oxygen. In order to obtain killed steel the oxygen must be bound, for which purpose aluminium is added. The effect of the aluminium is reduced if this also reacts with the oxygen in the initial slag cast. The steel quality may be reduced by an increase in the phosphorus and sulphur content in the steel, these elements being released in the reaction of aluminium and slag. These reactions also lead to unpredictable yields of the additives used during steel preparation. In addition the slag can cause unwanted inclusions in the steel. For all these reasons tapping of the initial slag with the steel must be avoided as much as possible.

In order to prevent these problems it has been proposed that the tap hole be sealed from outside the converter with a stopper. This stopper comprises a plug in the form of a truncated cone, the base circle of which is bigger than that of the tap hole, and a head circle which is smaller than that of the tap hole. The plug fits partly in the tap hole. See NL-A-No. 7612060 and U.S. Pat. No. 4,399,986 for example.

The stopper of NL-A-No. 7612060 is fixed in the tap hole by external fittings e.g. by a spring device located outside the converter which can exert a force on the head plate of the stopper. This head plate is made of steel with a thickness selected such that on tipping the converter it can hold back the converter slag running into the tap hole, but as a result of the load from the following steel melts within a few seconds.

The stopper of NL-A-No. 7612060 also comprises barbs around the circumference of the conical surface which serve to prevent the plug being pushed into the tap hole and which barbs probably also have a function of avoiding the conical plug tilting in the tap hole. This stopper has a number of disadvantages. When the converter is tipped a quantity of slag runs into the tap hole, and this slag has to be pushed out by the molten steel before the sealing effect of the stopper is lost. This does place requirements on the minimum holding time of the stopper. Also because the length of the tap hole is about 1.5 meters and the diameter 0.2 meters, so that the column of slag in the tap hole weighs about 700 kg, the ferrostatic pressure in the hole must also be taken into account.

In addition during the blowing process in the converter, the tap hole becomes silted up with slag, and it also happens that the tap hole is subject to wear near the internal wall of the converter as a result of direct contact with the blowing process.

In addition this known stopper can only be used with the external spring device which is expensive and requires special measures in order for it also to be used when the converter is tipped. In addition special measures are required to prevent the molten steel coming into contact with the spring device at the start of tapping of the molten steel, which would make reuse of this spring device impossible.

SUMMARY OF THE INVENTION

The object of the invention is to provide a stopper for a tap hole of a steel converter which avoids or reduces the problems described above and in particular overcomes the problem that slag enters the tap hole initially on tipping of the converter.

According to the present invention there is provided a stopper for a tap hole of a steel converter comprising a plug which has dimensions such that it can at least partly be fitted into the tap hole, and holding means for holding the plug in place in the tap hole. The stopper is characterised in that said plug is substantially cylindrical in shape and has dimensions such that it can be moved along the whole length of the tap hole and in that said holding means are adapted to lose their holding action when the stopper is subjected to the heat of the molten steel upon tipping of the converter.

Preferably the holding means comprise a plurality of resiliently flexible projections connected to the plug and of a length so as to extend beyond the periphery of the plug, which projections are arranged to engage and be bent by the tap hole wall so as to act in the manner of barbs on pushing of the plug into the tap hole from the outside of the converter, thereby to prevent movement of the plug towards the outside of the converter.

A cheap construction may be obtained by making these projections of strips of steel plate, or a similar material with the required flexibility and durability at normal temperatures in the tap hole.

The projections are preferably at least three in number and may form a star or cross, the advantage being obtained that when inserting the stopper into the tap hole no sideways forces need be exerted on the stopper to fit it in the centre of the tap hole.

The stopper can have, as means which prevent movement of the plug in the direction towards the inside of the converter, for example a chain which is fixed to the outside wall of the converter. A simple device with this function is also obtained if the stopper has holding means which can be actuated to prevent movement of the plug in the direction towards the interior of the converter and which comprise a rod connected to the plug and projecting when the plug is in its desired position in the tap hole, outside the tap hole on the outside of the converter, and at least one cross member adapted to be fixed to the rod part thus projecting outside the tap hole and engage the converter wall to prevent movement of the rod towards the interior of the converter. This also has the advantage that the plug can be fitted into the tap hole simply and be positioned by manipulating the rod.

A further advantage is that the insertion depth can be adjusted easily in this way to the thickness of the converter lining which is subject to wear as a result of use.

The plug can always be mounted level with the so-called hot face in the tap hole.

The plug can be formed from a refractory tamped mass which is enclosed in a casing of the required shape. A cheap construction can be obtained if the plug consists of a metal mould and concrete, which can most suitably be of the refractory type and which has been poured into and hardened in the metal mould. This also has the advantage that good adhesion of the rod to the plug can be obtained by incorporating one end of the rod in the concrete, with this end being fitted with an anchor, for example a cross-rod. In addition the casing offers protection against chipping of the concrete upon insertion into the tap hole. The simplicity of the structure is also promoted by the above-mentioned projections being fixed to the rod.

According to the invention in another aspect there is provided a method of operating a steel converter having a tap hole comprising the steps of (a) inserting a stopper of the invention as described above into the tap hole before tapping of the converter so that the plug of the stopper lies substantially at the inner end of the tap hole and (b) tipping the converter to bring molten steel into contact with the stopper so that the stopper first prevents slag on the steel from entering the tap hole and then is removed from the tap hole by the effect of the molten steel.

BRIEF INTRODUCTION OF THE DRAWINGS

A preferred embodiment of the invention is described below in more detail by way of nonlimitative example with reference to the accompanying drawings, in which.

DESCRIPTION OF THE PREFERRED EMBODIMENT

Figure 1:
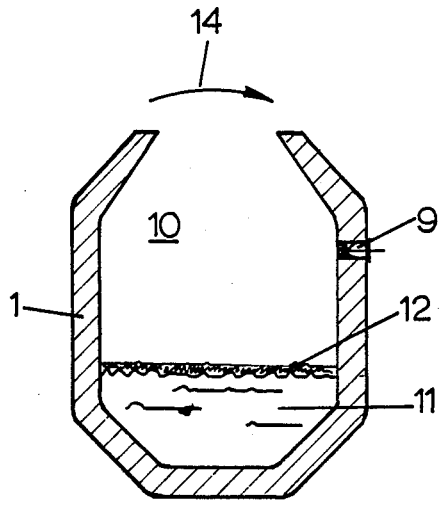
FIG. 1 is a cross-section of the converter and a tap hole.

The steel converter 10 shown in FIG. 1 contains a quantity of molten steel 11 on which a layer 12 of slag floats. When the steel converter is tipped in the direction shown by arrow 14 in order to pour the steel 11 into a steel ladle not shown, the slag layer 12 reaches the tap hole 9 first. In order to prevent the slag 12 being poured into the casting ladle, the tap hole 9 is sealed with a plug 2 (see FIG. 2) for each charge of the converter. This cylindrical plug 2 is already fitted before the oxygen blowing in the converter 10, in order to prevent the escape of reaction gas through the tap hole 9.

The plug 2 is part of a stopper for the tap hole which consists of the plug 2, a rod 5 and holding devices 4,8. The plug 2 can be fitted easily into the tap hole 9, since it is connected to the rod 5 by which it can be manipulated. The connection between the plug 2 and the rod 5 is obtained simply by the rod 5 being insert cast in the plug 2. This connection is made stronger because the rod 5 carries a cross-rod 6 which is also insert cast in the plug 2. The plug 2 is of concrete with refractory properties cast and hardened in a metal mould 3. The mould 3 gives the plug the required shape and prevents damage to the plug during insertion into the tap hole 9.

The rod 5 is fitted with four resiliently bendable wings 4 of strip steel which act as barbs by contacting the tap hole wall so that the plug 2 cannot move back towards the outside of the converter 10. Movement of the plug towards the inside of the converter 10 is prevented by a rod 8 which is inserted through one of a plurality of holes 7 of the rod 5 and rests against the outside wall 13 around the tap hole 9 of the converter 10.

Figure 2:
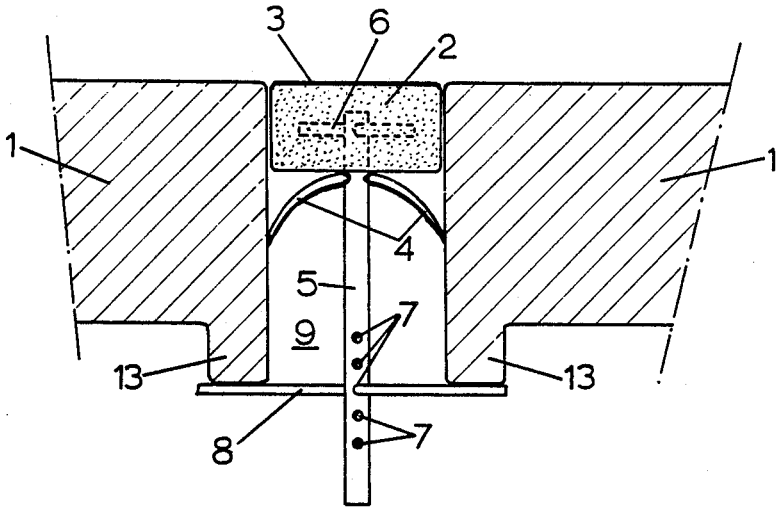
FIG. 2 shows a stopper embodying the invention in cross section in its fitted position in the tap hole of the converter.

It can be seen in FIG. 2 that the plug 2 is located so that its end face is flush with the inside wall face of the converter 10. This prevents slag entering the tap hole on the initial tipping of the converter. When tipping movement of the converter 10 has been completed, the molten steel 11 subjects the plug 2 to a high temperature and pressure, so that the plug 2 and the wings 4 soften, which may be accompanied by melting of the casing 3 and wings 4, after which the flow of steel through the tap hole 9 commences.

What is claimed is:

1. A stopper for a tap hole of a steel converter comprising (a) a substantially cylindrical plug which has dimensions such that it can be moved along the whole length of the tap hole and (b) holding means for holding the plug in place in the tap hole, said holding means being adapted to lose their holding action when the stopper is subjected to the heat of the molten steel upon tipping of the converter, said holding means comprising a plurality of resiliently flexible projections connected to the plug and of a length so as to extend beyond the periphery of the plug, which projections are arranged to engage and be bent by the tap hole wall so as to act in the manner of barbs on pushing of the plug into the tap hole from the outside of the converter, thereby to prevent movement of the plug towards the outside of the converter, said projections being carried by a rod fixed to the plug and extending along the tap hole away from the plug in the mounted position of the stopper.

2. A stopper for a tap hole of a steel converter comprising a substantially cylindrical plug which has dimensions such that it can be moved along the whole length of the tap hole, (b) a first holding means for holding the plug in place in the tap hole, said first holding means being adapted to lose their holding action when the stopper is subjected to the heat of the molten steel upon tipping of the converter and (c) a second holding means which can be actuated to prevent movement of the plug in the direction towards the interior of the converter and which comprises a rod connected to the plug and projecting when the plug (2) is in its desired position in the tap hole, outside the tap hole on the outside of the converter, and at least one cross member adapted to be fixed to the rod part thus projecting outside the tap hole and engage the converter wall to prevent movement of the rod towards the interior of the converter.

3. A stopper for a tap hole of a steel converter comprising (a) a substantially cylindrical plug which has dimensions such that it can be moved along the whole length of the tap hole and (b) holding means separate from the plug for holding the plug in place in the tape hole, said holding means being adapted to lose their holding action when the stopper is subjected to the heat of the molten steel upon tipping of the converter, said plug comprising a metal mould and concrete which has been poured into and hardened in the mould.

4. A stopper to claim 3 wherein the said concrete is a refractory concrete.

5. A stopper according to claim 3 having a rod which has an anchor attached thereto and has one end and said anchor embedded in said concrete.

* * * * *